US005576167A

United States Patent [19]

Poslusny et al.

[11] Patent Number: 5,576,167

[45] Date of Patent: Nov. 19, 1996

[54] PHOTOGRAPHIC ELEMENT CONTAINING A STABLE ARYLOXYPYRAZOLONE COUPLER AND PROCESS EMPLOYING SAME

[75] Inventors: Jerrold N. Poslusny, Rochester, N.Y.; Lawrence G. Anderson, Pittsburgh, Pa.; Jared B. Mooberry, Rochester; Zheng Z. Wu, Penfield, both of N.Y.

[73] Assignee: Eastman Kodak Company, Rochester, N.Y.

[21] Appl. No.: 367,552

[22] Filed: Dec. 30, 1994

[51] Int. Cl.[6] ..... G03C 7/384; G03C 7/305

[52] U.S. Cl. ..... 430/555; 430/544; 430/955

[58] Field of Search ..... 430/544, 555, 430/957, 955, 956, 958, 959, 960

[56] References Cited

U.S. PATENT DOCUMENTS

| | | | |
|---|---|---|---|
| 3,419,391 | 12/1968 | Young | 430/555 |
| 4,248,962 | 2/1981 | Lau | 430/544 |
| 4,409,323 | 10/1983 | Sato et al. | 430/544 |
| 4,524,130 | 6/1985 | Iwasa et al. | 430/544 |
| 4,609,620 | 9/1986 | Postle et al. | 430/555 |
| 4,912,025 | 3/1990 | Platt et al. | 430/544 |
| 5,250,399 | 10/1993 | Szajewski et al. | 430/544 |

FOREIGN PATENT DOCUMENTS

| | | | |
|---|---|---|---|
| 3133152 | 6/1988 | Japan | 430/555 |
| 1231049 | 9/1989 | Japan | 430/555 |
| 939904 | 10/1963 | United Kingdom | 430/555 |

*Primary Examiner*—Lee C. Wright
*Attorney, Agent, or Firm*—Arthur E. Kluegel

[57] ABSTRACT

A photographic element comprises a light-sensitive silver halide emulsion layer having associated therewith a coupler based on a 1-aryl-2-pyrazolin-5-one ring and represented by formula I:

I wherein:

$Ar^1$ and $Ar^2$ are each independently aryl groups comprising a carboaromatic or heteroaromatic ring;

X, Y, and Z are bonded to a carbon atom alpha to the 3-position and are independently selected from the group consisting of hydrogen and substituent groups such that the sum of the Taft $\sigma^*$ values for X, Y, and Z is at least 1.5;

R represents n independently selected substituent groups bonded to the $Ar^2$ ring, provided that the sum of the appropriate Hammett $\sigma$ constants for all R substituent groups is at least 0.3, and provided further that two of X, Y, and Z may join to form a ring; and n is 0 to 5;

provided that R may not be a nitro group ortho to the oxygen atom bonding $Ar^2$ to the 1-aryl-2-pyrazolin-5-one ring.

22 Claims, No Drawings

PHOTOGRAPHIC ELEMENT CONTAINING A STABLE ARYLOXYPYRAZOLONE COUPLER AND PROCESS EMPLOYING SAME

FIELD OF THE INVENTION

This invention relates to a photographic element having a light-sensitive silver halide emulsion layer having associated therewith a stable 1-aryl-2-pyrazolin-5-one based magenta coupler having an aryl group linked by an oxygen atom to the coupling position of the pyrazolone ring.

BACKGROUND OF THE INVENTION

In a silver halide photographic element, a color image is formed when the material is exposed to light and then developed using a primary amine color developer. The development results in imagewise reduction of silver halide and the corresponding production of oxidized developer. The oxidized developer then reacts in an imagewise fashion with one or more incorporated dye-forming couplers to form a dye image.

Magenta dye-forming couplers are employed in subtractive color forming processes. One of the principal coupler types useful for this purpose are those based on a pyrazolone ring. Pyrazolone-based couplers having a coupling-off group linked to the pyrazolone ring by oxygen have long been considered as potentially attractive two equivalent magenta couplers. An oxygen-linked coupling-off group could impart increased activity to the pyrazolone coupler; however the general instability of these couplers toward ambient oxygen makes them difficult to synthesize and impractical for use in a film environment since they decompose during keeping. In particular, pyrazolone couplers having an anilino or acylamino substituent at the 3-position have exhibited unacceptable stability when an aryloxy is employed as a coupling-off group. As a result, pyrazolone couplers have employed either so-called "four equivalent" couplers containing hydrogen at the coupling-off position or have employed so-called "two-equivalent" couplers containing a coupling-off group having a sulfur or nitrogen atom linked to the pyrazolone ring.

U.S. Pat. No. 3,419,391 discloses certain types of pyrazolone-based compounds as two-equivalent couplers having high dye-forming reactivity and reduced tendency to form color fog. According to the patent, the pyrazolone ring is not limited to the presence of any particular substituents at the 3-position or elsewhere. Specifically identified substituents at the 3-position include anilino, acylamino, alkyl, amino, alkoxy, amido, carbamoyl, ureido, thio, guanidino, etc. The couplers of the patent may contain an aryl group at the 1-position and, among other things, an alkyl or carboxy ester group at the 3-position. The aryloxy couplers of the patent are said not to produce color fog (printout) and to provide improved reactivity. Thus, they are said to provide low printout or yellowing in Dmin areas when they are exposed to light or high temperatures, respectively, subsequent to development. No mention is made of the poor keeping of pyrazolone couplers having aryloxy coupling-off groups although their instability is well known in the art.

In an attempt to overcome the instability of 1-aryl-4-aryloxy-2-pyrazolin-5-one couplers, it has been proposed in a copending application to include a stabilizing component in association with the layer containing the pyrazolone. The proposed compound is a sulfide, sulfoxide or sulfone compound.

It would be desirable to have a pyrazolone-based coupler with an aryloxy coupling-off group that would be stable in a photographic element that is stable during synthesis, film manufacture, and during film keeping and would provide an acceptable hue and reactivity but which would not require the presence of stabilizer compounds, particularly those which might introduce sulfur to the photographic element.

SUMMARY OF INVENTION

The invention provides a photographic element which comprises a light-sensitive silver halide emulsion layer having associated therewith a coupler based on a 1-aryl-2-pyrazolin-5-one ring and represented by formula I:

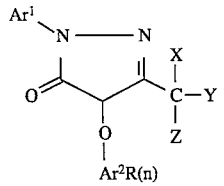

I wherein:

$Ar^1$ and $Ar^2$ are each independently aryl groups comprising a carboaromatic or heteroaromatic ring;

X, Y, and Z are bonded to a carbon atom alpha to the 3-position and are independently selected from the group consisting of hydrogen and substituent groups such that the sum of the Taft $\sigma^*$ values for X, Y, and Z is at least 1.5;

R represents n independently selected substituent groups bonded to the $Ar^2$ ring, provided that the sum of the appropriate Hammett $\sigma$ constants for all R substituent groups is at least 0.3, and provided further that two of X, Y, and Z may join to form a ring; and n is 0 to 5;

provided that R may not be a nitro group ortho to the oxygen atom bonding $Ar^2$ to the 1-aryl-2-pyrazolin-5-one ring.

The invention also encompasses a process for forming an image in the described element after exposure to light comprising contacting the element with a color developing chemical.

A photographic element in accordance with the invention exhibits an improved keeping stability of the magenta dye forming coupler and acceptable hue and reactivity even in the absence of a stabilizing compound.

DETAILED DESCRIPTION OF INVENTION $Ar^1$ and $Ar^2$ are each independently selected aryl groups and may comprise a carboaromatic or heteroaromatic group and may include any groups usable as substituents, as described hereinafter. The $Ar^1$ aryl group may be, for example, phenyl, trichlorophenyl, pyridyl, naphthyl, quinolinyl, etc.

Based on the results of testing, it is believed that the proper selection of substituents for $Ar^2$ can be accomplished by calculating the sum of the Hammett's Sigma constant values for all of the $Ar^2$ substituents. When $Ar^2$ comprises a carbocyclic aromatic group, n is at least 1, and the R substituents are independently selected from the groups usable as substituents described hereinafter, provided that there are among the R substituent groups sufficient electron withdrawing capacity such that the sum of the Hammett's constant values for all R substituents ($\sigma_p$ for an ortho or para position or $\sigma_m$ for a meta position depending on the location of each said R group relative to the oxygen atom linking $Ar^2$ to the pyrazolone ring) is at least 0.3. See "Survey of Hammett Substituent Constants and Resonance Field Parameters", C. Hansch, A. Leo, and R. Taft, Chem. Rev., 91, 165–195, (1991), for a definition of the terms and for a table of constant values for various substituents.

In the case where the $Ar^2$ aryl group comprises a heteroaromatic ring, an adjustment factor must be included in determining the $\Sigma\sigma$ in accordance with the identity and location of the heteroatoms in the heteroaromatic ring. Such adjustment values are given for example in Table A.6 of the *$pK_a$ Prediction for Organic Acids and Bases* as cited below. Thus, in the case of M-13 where there is no substituent on $Ar^2$, the ortho pyridine itself provides a $\sigma$ of 0.56 which exceeds the required 0.3, and therefore no electron withdrawing substituent is necessary.

In the case of $Ar^2$ being a carbocyclic aromatic group, since positive $\sigma$ values represent electron withdrawing character and since the value for hydrogen is 0, it follows that a sum of 0.3 can only be achieved by the presence of at least one electron withdrawing R group. Examples of substituents useful include halogen, —$NO_2$, —CN, —NR'$SO_2$R", —NR'C(O)R", —C(O)N(R')R", —C(O)OR', —OC(O)R', —C(O)R', —$OSO_2$R',—$SO_2$R', —$SO_2$N(R')R", —$SO_2$OR' and —$CF_3$ wherein each R' and R" is independently hydrogen or a substituent group. Examples of suitable specific substituents include the following: sulfamoyl, such as N-methylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as hexadecylsulfamido and N-octdecylmethylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, phenoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkanesulfonyl, such as alkanesulfonyl containing 1 to 30 carbon atoms, for example methanesulfonyl, octanesulfonyl, 2-ethylhexanesulfonyl, and hexadecanesulfonyl; arenesulfonyl, such as benzenesulfonyl, 4-nonylbenzenesulfonyl, and p-toluenesulfonyl. Sulfinyl and sulfoxyl compounds corresponding to the foregoing sulfonyl compounds are also suitable. The $Ar^2$ group is suitably exemplified by groups such as phenyl, naphthyl, pyridinyl, pyrimidinyl, pyrazolyl, imidazolyl, guinolinyl, and the like.

It is essential that the $Ar^2$ aryl group not include a nitro group ortho to the oxygen atom linking $Ar^2$ to the pyrazolone ring. The exclusion of ortho nitro on $Ar^2$ is necessitated by its very strong destabilizing effect on the corresponding pyrazolone couplers which leads to their very rapid decomposition. Such combination provides an unstable coupler as demonstrated by coupler C-5 in Example 2.

Based on the results of testing, it is believed that X, Y, and Z, which are bonded to a tetrahedral carbon atom alpha to the 3-position, may be independently selected from hydrogen and substituent groups within the general description of groups usable as substituents, as described hereinafter, such that the sum of the Taft $\sigma^*$ constant values for X, Y, and Z is at least 1.5. The Taft $\sigma^*$ constant is described in *$pK_a$ Prediction for Organic Acids and Bases*, D. Perrin, B. Dempsey, and E. Serjeant, Chapman and Hall, New York, N.Y.(1981). It represents the electronic effect of a substituent in an aliphatic system. Values for various substituents may be found in Appendix Table A-1 of the above publication. Hydrogen has a $\sigma^*$ value of +0.49 and methyl has a value of 0.

The $\sigma^*$ constant value of a substituent may be determined by reference to the tables of the above publication. Table A.2 in the above reference contains a compilation of published Taft equations, in which various parent compounds (acids or bases) are utilized.

As an alternative, one may determine the value experimentally from the formula:

$$\sigma^*=(pK^\circ-pK)/\rho^*$$

where $\rho^*$ is the reaction constant which is the slope of the straight line plot of $pK^\circ-pK$ versus $\sigma^*$ for known substituents of the base compound where $pK^\circ$ is the ionization constant of the base compound at 25° C., and pK is the ionization constant of the substituted compound at 25° C., which may be determined experimentally in accordance with conventional techniques. $\rho^*$ may be determined from the slope of the linear plot of $(pK^\circ-pK)$ vs. $\sigma^*$ values experimentally determined or from Table A.2 of the above publication. Reference may also be made to *Mechanism and Theory in Organic Chemistry, 3rd Ed,* T. H. Lowry. and K. S. Richardson, Harper and Row, New York, (1987).

Two of X, Y, and Z may combine to form a ring. In such instance, two Values for use in calculating the value of $\sigma^*$ may be determined by determining two values for $\sigma^*$ by first treating the ring forming substituent as two separate substituents, first ignoring one of the atoms bonded directly to the alpha carbon and determining a $\sigma^*$ value as if it was not a ring and bonded at only one end, and then ignoring the other of the atoms bonded directly to the alpha carbon and determining a $\sigma^*$ value as if it was not a ring and bonded at only one end. These separate values are then added for use in computing $\sigma^*$.

Desirably, at least one of X, Y, or Z is an electron withdrawing group selected from an aromatic carbocyclic group, —OAr, —SAr, —OR', —SR', —CN, —NR'$SO_2$R", —NR'C(O)R", —C(O)N(R')R", —C(O)OR', —OC(O)R', —C(O)R', —$OSO_2$R', —SOR', —$SO_2$R', —$SO_2$N(R')R" and halogenated alkyl such as —$CF_3$ and the foregoing groups which are electron withdrawing groups when bonded to the alpha carbon through an alkylene group, wherein each R' and R" is independently hydrogen or a substituent group and Ar is a carbocyclic or heterocyclic aryl group. Thus suitable substituent for the carbon alpha to the carbon in the 3-position of the 1-aryl-2-pyrazolin-5-one ring include, for example, a carbocyclic aromatic ring, phenoxy, sulfonyl, sulfonyloxy, sulfoxy, acyl, acylamino, acyloxy, alkoxy, alkylthio, alkoxycarbonyl, alkylthio, carbamoyl, sulfamoyl, sulfonamido, phenyl, cyano, trifluoromethyl, and phenylthio groups.

Also within the scope of the invention are couplers which release a photographically useful group PUG). PUG can be any photographically useful group known in the art. For example, PUG can be a dye or dye precursor, such as a sensitizing dye, filter dye, image dye, leuco dye, blocked dye, shifted dye, or ultraviolet light absorber. Alternatively PUG can be a photographic reagent, which upon release can further react with components in the element. Such reagents include development accelerators or inhibitors, bleach accelerators or inhibitors, couplers (e.g. competing couplers, color-forming couplers, or DIR couplers), developing agents (e.g. competing developing agents or auxiliary developing agents), silver complexing agents, fixing agents, toners, hardeners, tanning agents, fogging agents, antifoggants, antistain agents, stabilizers, nucleophiles and dinucleophiles, and chemical or spectral sensitizers and desensitizers.

Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

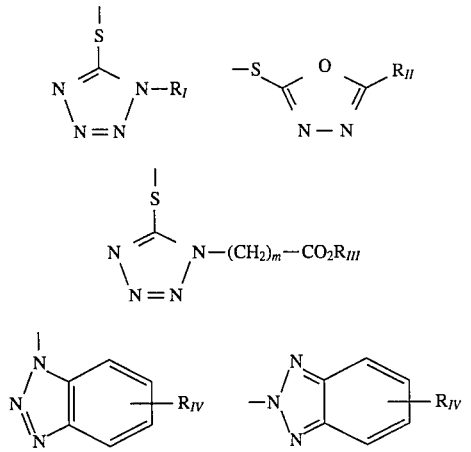

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

The 4-aryloxy group of the invention may function as a timing group and may typically have one of the formulas:

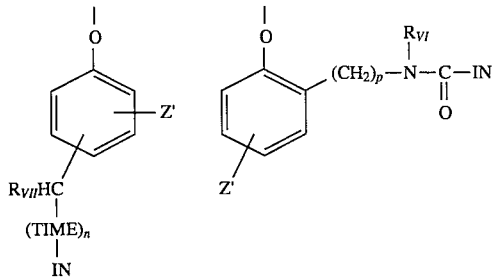

wherein IN is the inhibitor moiety, Z' is an electron withdrawing group such as nitro, cyano, alkylsulfonyl; sulfamoyl (—$SO_2NR_2$); and sulfonamido (—$NRSO_2R$) groups; $R_{VI}$ is an alkyl or phenyl group; $R_{VII}$ is hydrogen or an alkyl group; TIME is a timing group; n is 0, 1, or 2; and P is 0 or 1. The oxygen atom is bonded to the 4-position of the 1-aryl-2-pyrazolin-5-one coupler.

The 4-aryloxy group of the invention which provides a timed release of the inhibitor and the optional timing group(s) which produce(es) the further time-delayed release of the inhibitor group include those such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above.

It is within the scope of the invention that the coupler of the invention be provided in polymeric form. Thus the coupler may be part of a repeating unit of a polymer. For example, the coupler may be provided via the formula:

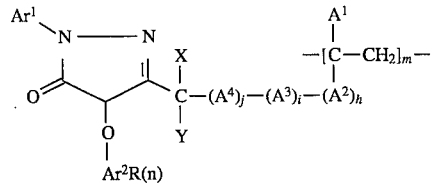

where the group "Z" is represented by the group

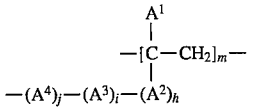

$A^1$ represents a hydrogen atom or a lower alkyl group having 1 to 5 carbon atoms;

$A^2$ represents phenylene, —COO— or —CONH—;

$A^3$ represents an alkylene group such as —$(CH_2)_n$— where n=1 to 10; or arylene such as o-arylene group, m-arylene group, or p-arylene group;

$A^4$ represents —O—, —S—, —N(R)C(O)—, —C(O)N(R)—, —$OSO_2$—, —$SO_2$—, —C(O)O—, —OC(O)—, —N(R)$SO_2$—, and —$SO_2$N(R)— where each R is independently hydrogen or a substituent; and h, i, and j are each 0 or 1 but not all are 0.

The coupler can also be a copolymer with at least one repeating unit which is not capable of forming color with oxidized color developing agent.

The invention also encompasses a process for forming an image in the described element by contacting an element which has been exposed to light with a color developing chemical.

Coupler compounds in accordance with the invention are exemplified by the following with the corresponding values for the sum of the Hammett (σ) constants and Taft (σ*) constants as shown:

| COUPLER | FORMULA | Σσ | Σσ* |
|---|---|---|---|
| M-1 | 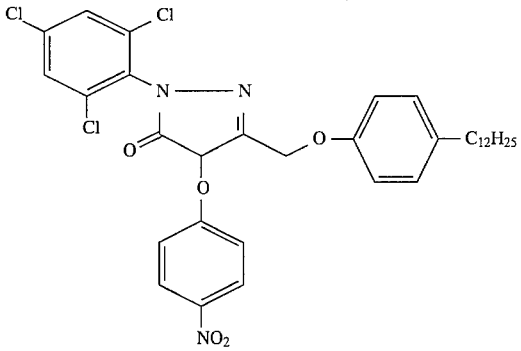 | 0.78 | 3.28 |
| M-2 | 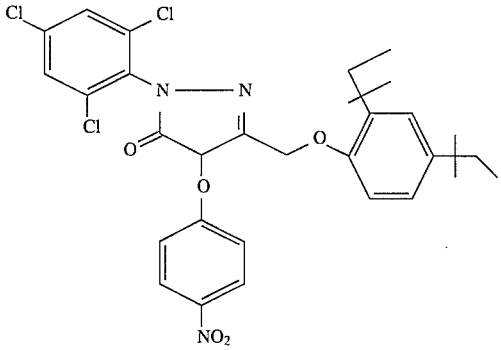 | 0.78 | 3.28 |
| M-3 | 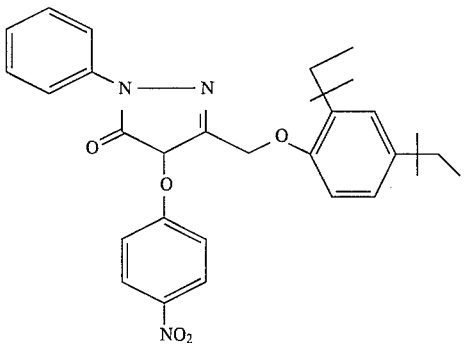 | 0.78 | 3.28 |
| M-4 | 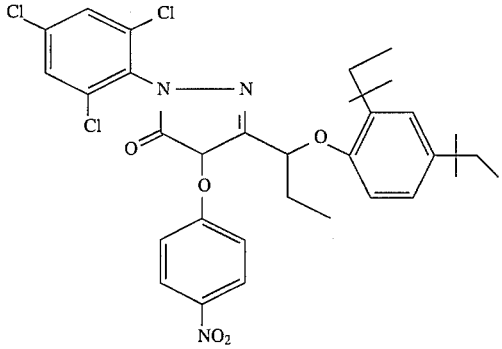 | 0.78 | 2.69 |

-continued
| COUPLER | FORMULA | Σσ | Σσ* |
|---|---|---|---|
| M-5 | 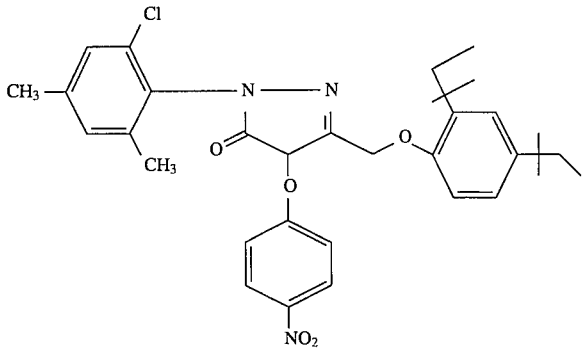 | 0.78 | 3.28 |
| M-6 | 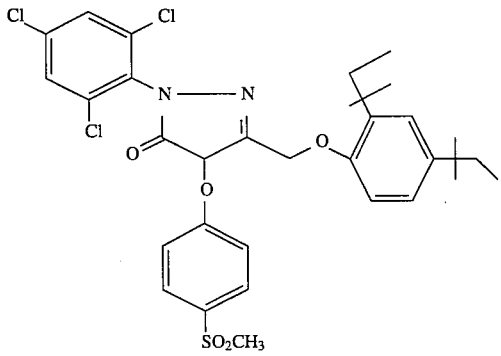 | 0.73 | 3.28 |
| M-7 | 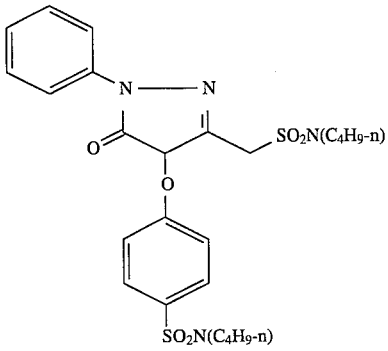 | 0.65 | 3.60 |
| M-8 | 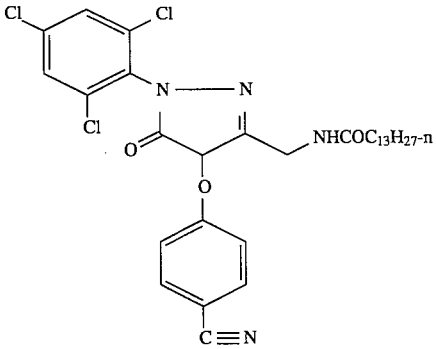 | 0.70 | 2.38 |

-continued
| COUPLER | FORMULA | Σσ | Σσ* |
|---|---|---|---|
| M-9 | 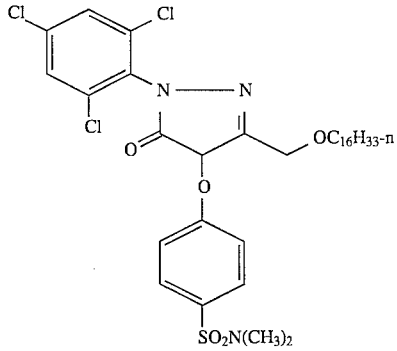 | 0.65 | 2.67 |
| M-10 | 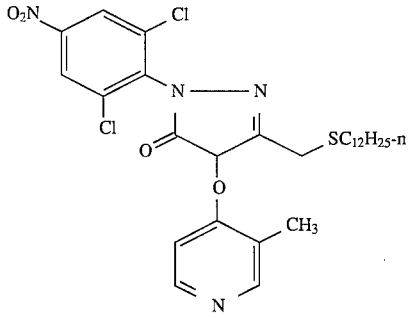 | 0.69 | 2.54 |
| M-11 | 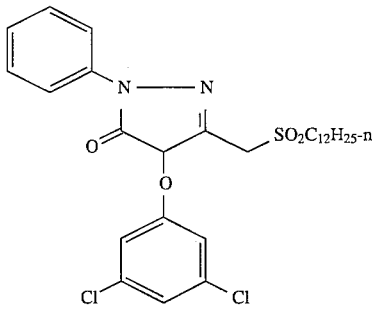 | 0.74 | 4.54 |
| M-12 | 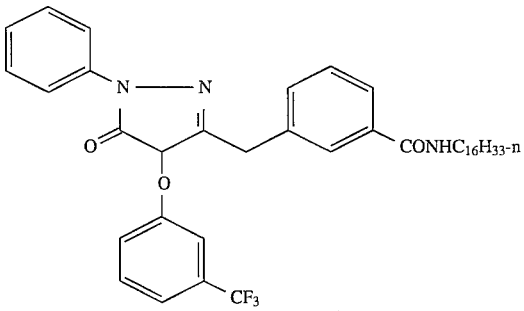 | 0.43 | 3.88 |
| M-13 | 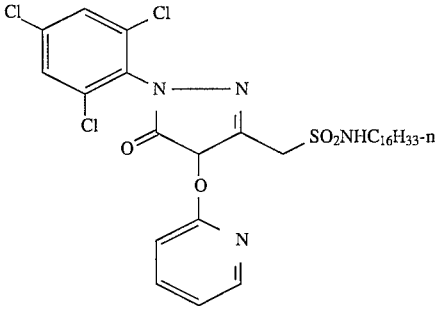 | 0.56 | 3.58 |

-continued
| COUPLER | FORMULA | Σσ | Σσ* |
|---|---|---|---|
| M-14 | 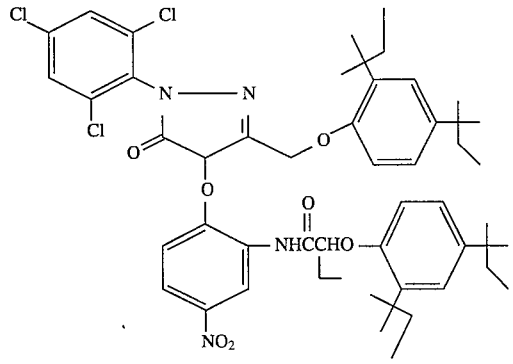 | 0.69 | 3.28 |
| M-15 | 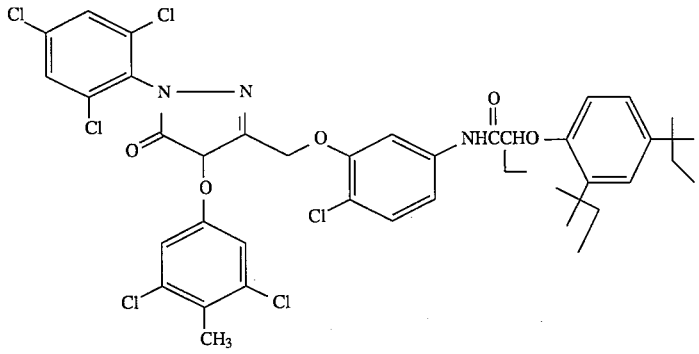 | 0.60 | 5.07 |
| M-16 | 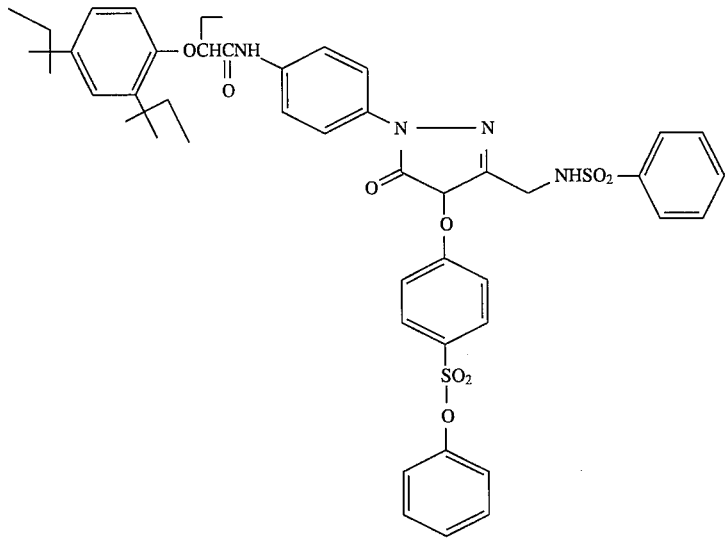 | 0.51 | 2.97 |
| M-17 | 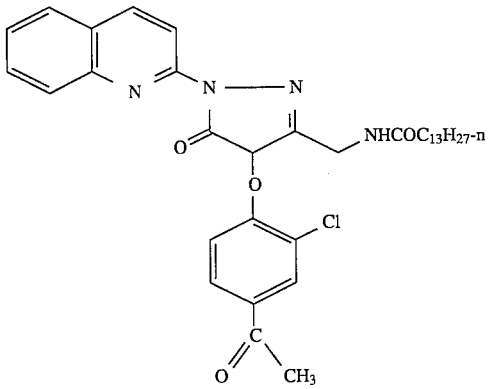 | 0.71 | 2.38 |

-continued
| COUPLER | FORMULA | Σσ | Σσ* |
|---|---|---|---|
| M-18 | 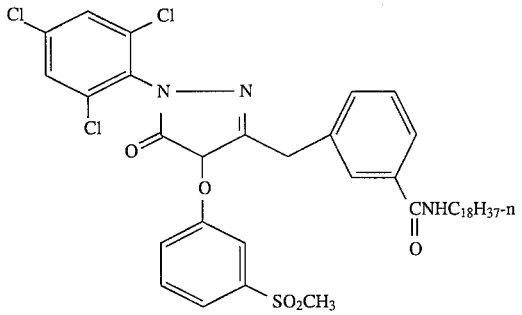 | 0.64 | 3.88 |
| M-19 | 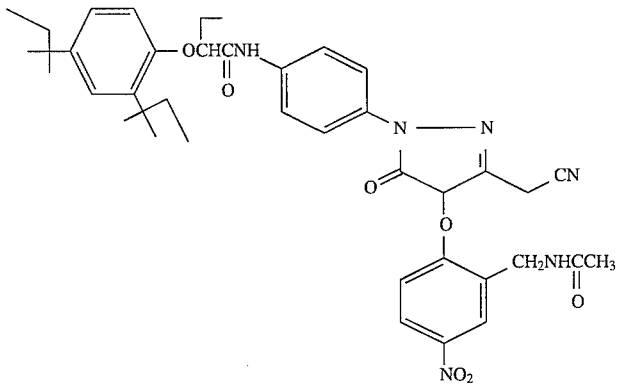 | 0.73 | 4.28 |
| M-20 | 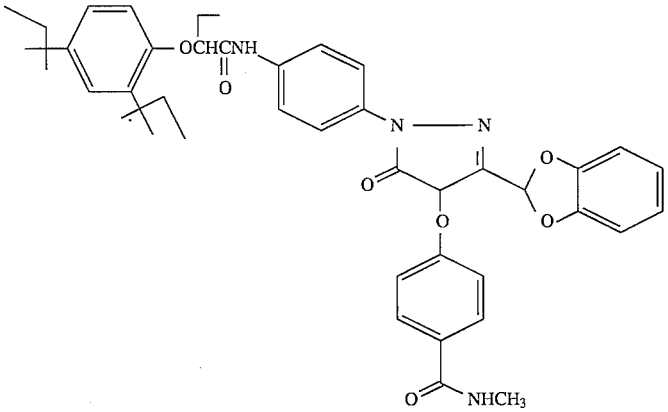 | 0.36 | 5.35 |
| M-21 | 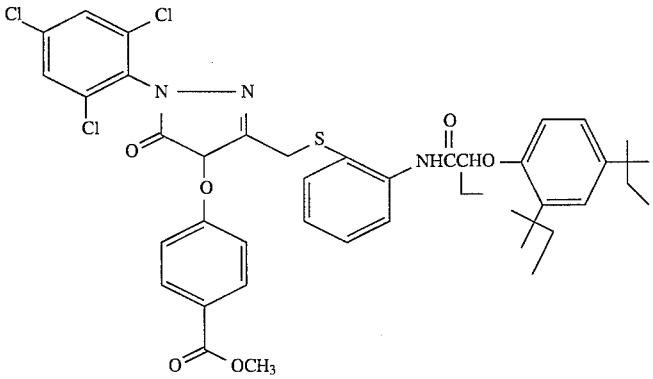 | 0.39 | 4.25 |

-continued
| COUPLER | FORMULA | Σσ | Σσ* |
|---|---|---|---|
| M-22 | 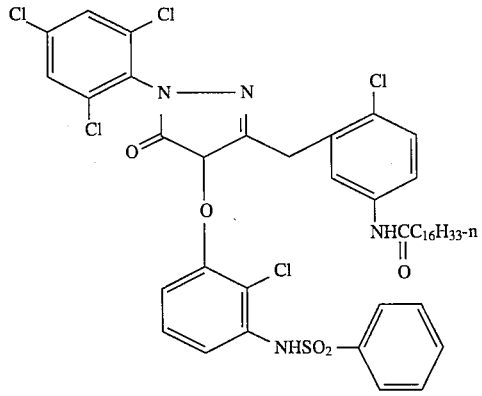 | 0.40 | 3.43 |
| M-23 | 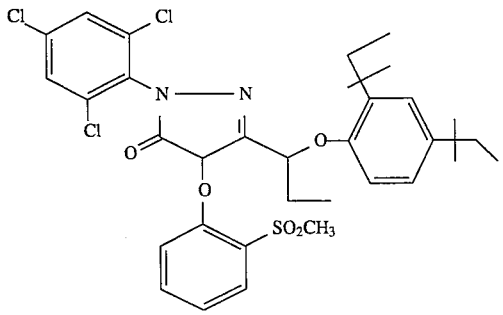 | 0.73 | 2.69 |
| M-24 | 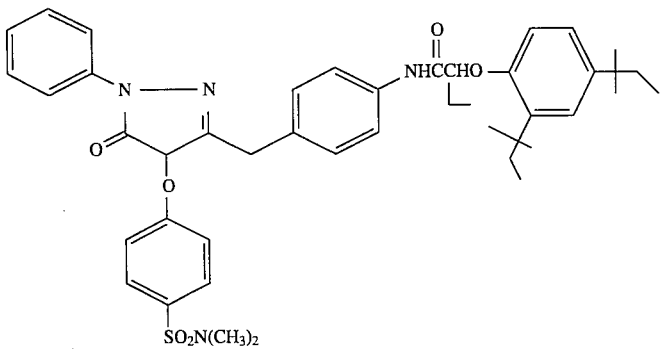 | 0.65 | 3.13 |
| M-25 | 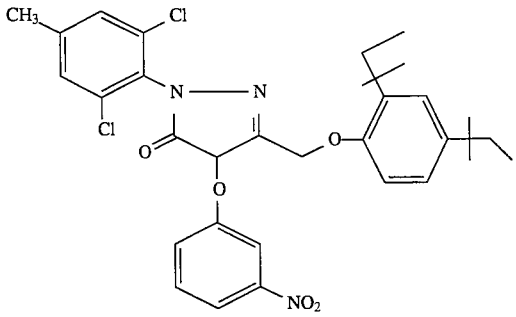 | 0.74 | 3.28 |

-continued
| COUPLER | FORMULA | Σσ | Σσ* |
|---|---|---|---|
| M-26 | 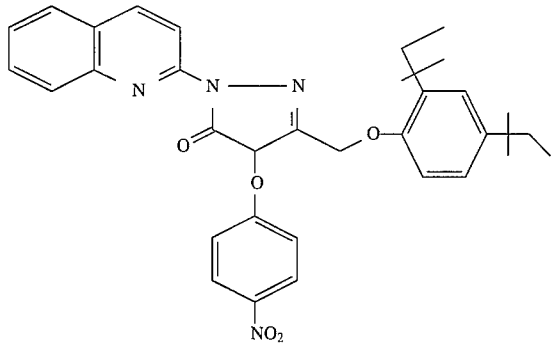 | 0.78 | 3.28 |
| M-27 | 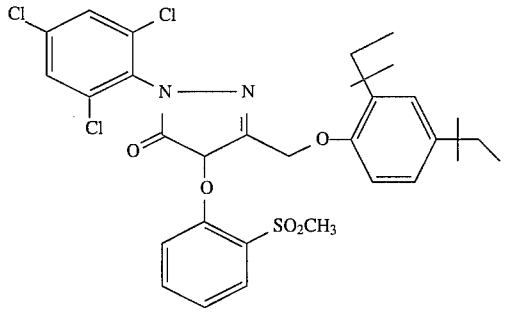 | 0.73 | 3.28 |
| M-28 | 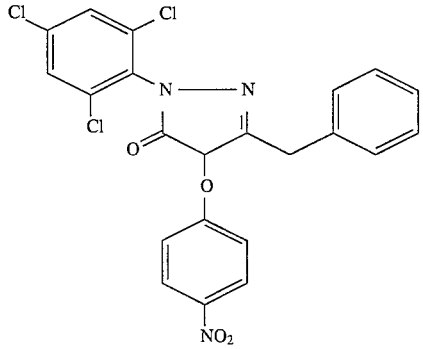 | 0.78 | 1.73 |
| M-29 | 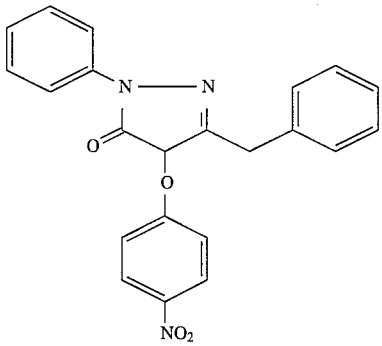 | 0.78 | 1.73 |

-continued
| COUPLER | FORMULA | Σσ | Σσ* |
|---|---|---|---|
| M-30 | 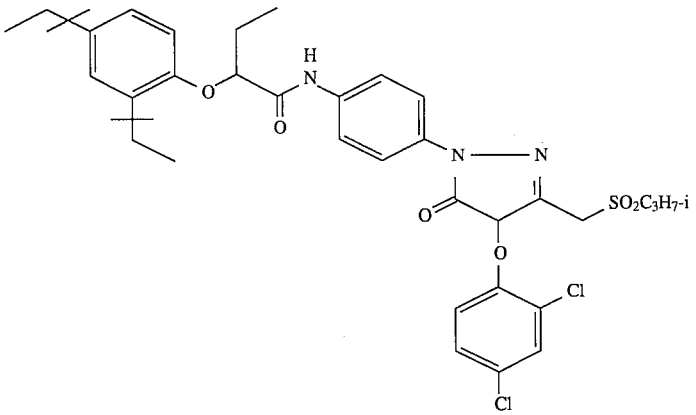 | 0.48 | 4.66 |
| M-31 | 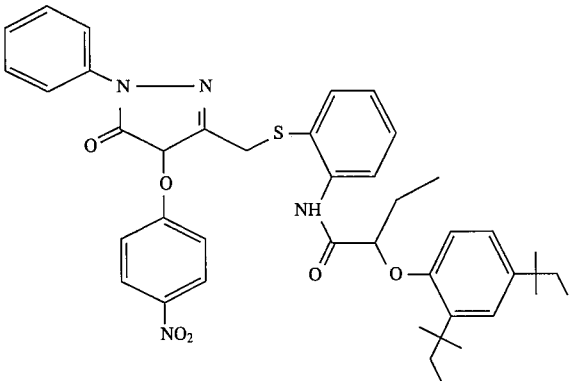 | 0.78 | 4.25 |
| M-32 | 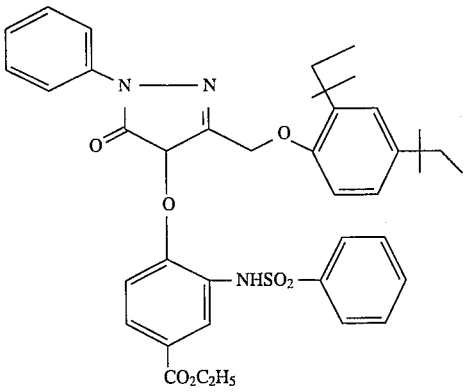 | 0.46 | 3.28 |
| M-33 | 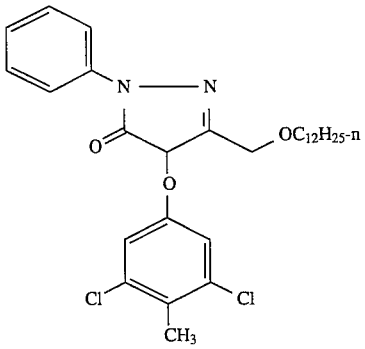 | 0.60 | 2.67 |

-continued
| COUPLER | FORMULA | Σσ | Σσ* |
|---|---|---|---|
| M-34 | 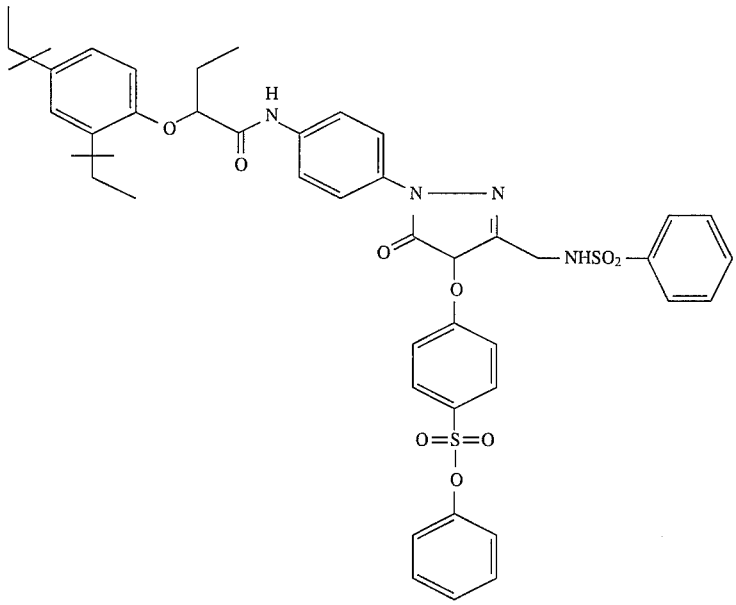 | 0.51 | 2.97 |
| M-35 | 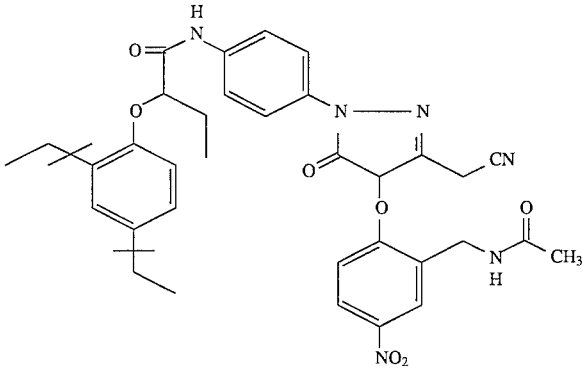 | 0.73 | 4.28 |
| M-36 | 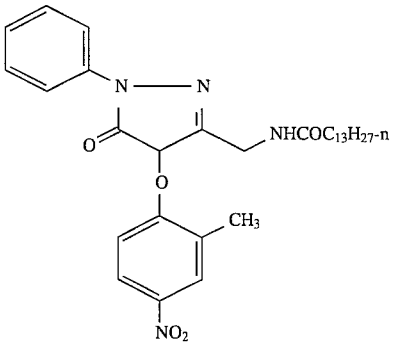 | 0.64 | 2.38 |

-continued
| COUPLER | FORMULA | Σσ | Σσ* |
|---|---|---|---|
| M-37 | 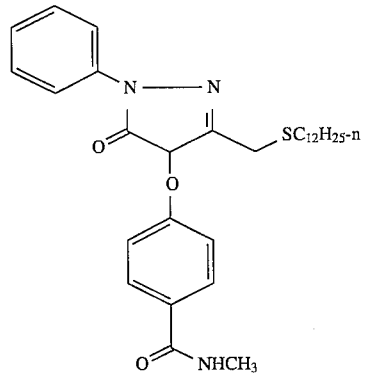 | 0.36 | 2.54 |
| M-38 | 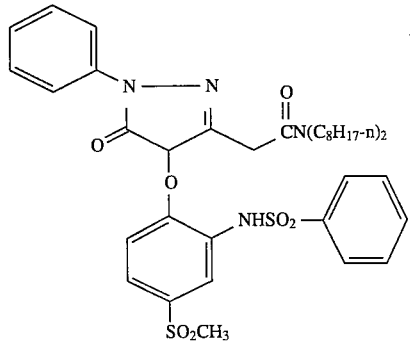 | 0.74 | 2.92 |
| M-39 | 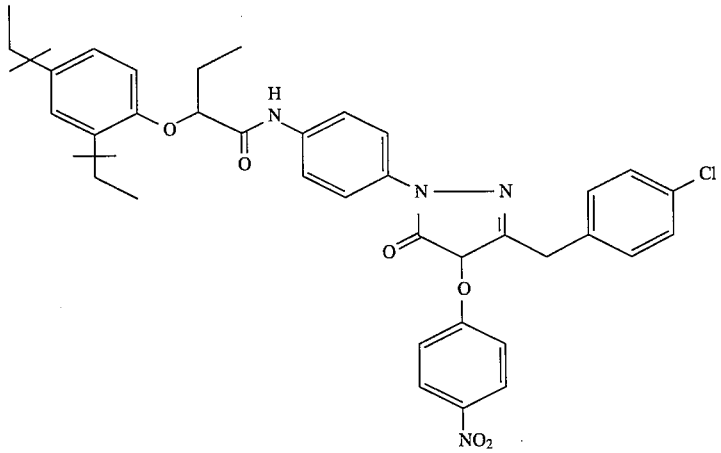 | 0.78 | 1.85 |
| M-40 | 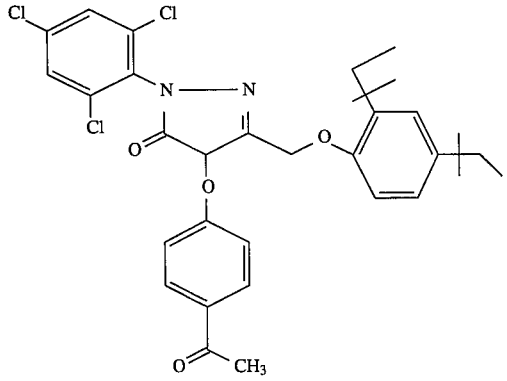 | 0.47 | 3.28 |

-continued

| COUPLER | FORMULA | Σσ | Σσ* |
|---|---|---|---|
| M-41 | 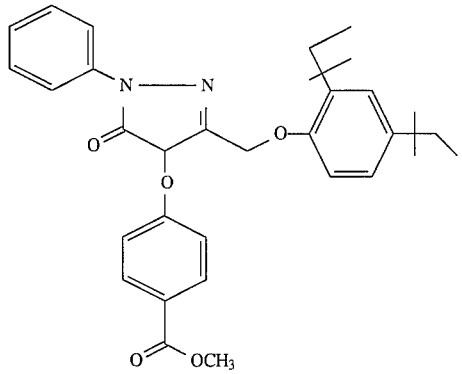 | 0.39 | 3.28 |
| M-42 | 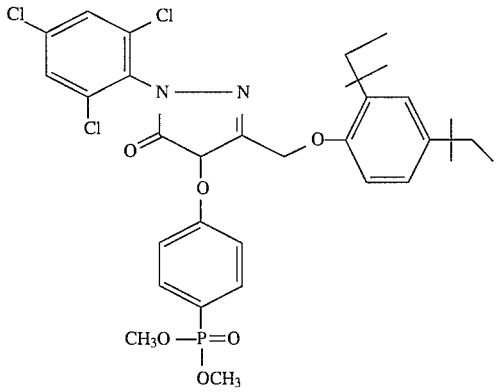 | 0.55 | 3.28 |
| M-43 | 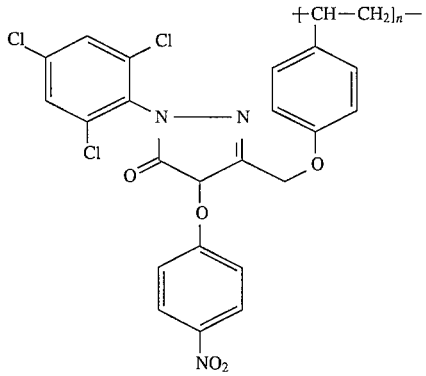 | 0.78 | 3.28 |
| M-44 | 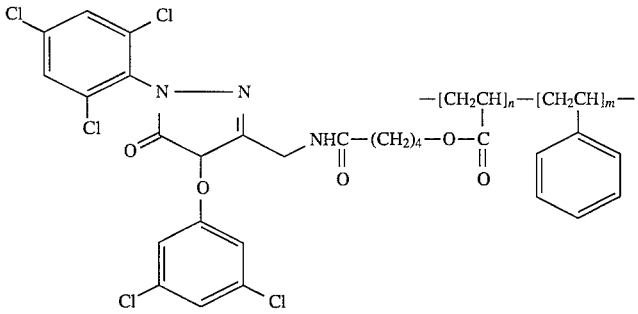 | 0.74 | 2.38 |

Unless otherwise specifically stated, substituent groups usable on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and Vi through VIII. Color materials are described in Sections X through XIII. Scan facilitating is described in Section XIV. Supports, exposure, development systems, and processing methods and agents are described in Sections XV to XX.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961) . Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620 , 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 ,and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl)amino)-, dodecyl ester and a slow yellow layer containing the same compound together with "Coupler 2": Propanoic acid, 2-[[5-[[4-[2-[[[2,4-bis(1,1- dimethylpropyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4) (5) (6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino )-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino) carbonyl)-5-hydroxy-1-naphthalenyl)-, 2-methylpropyl ester, "Coupler 7": Acetic acid, ((2-((3-(((3-(dodecyloxy)propyl)amino) carbonyl)-4-hydroxy-8-(((2-methylpropoxy)carbonyl) amino)-1-naphthalenyl)oxy)ethyl)thio)-, and "Coupler 8" Benzamide, 3-((2-(2,4-bis (1,1-dimethylpropyl) phenoxy)-1-oxobutyl)amino)-N-(4,5-dihydro-4-((4-methoxyphenyl)azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol -3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino) carbonyl)-4-hydroxy-1-naphthalenyl)oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl)- and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer containing "Coupler 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom: (1) one or more overcoat layers; (2) a nonsensitized silver halide containing layer; (3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-his (1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy) acetyl)amino)-N-(4,5-dihydro-5-oxo-1-(2,4,6-trichlorophenyl)-1H-pyrazol-3-yl)-; and containing the stabilizer 1,1'-Spirobi (1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl)amino)-3-hydroxyphenyl)-; a mid cyan containing "Coupler 7": Butanamide, N-(4-((2-(2,4-bis(1, 1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroguinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazotes, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

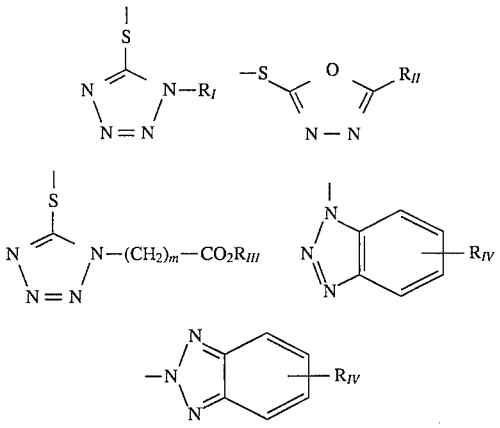

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

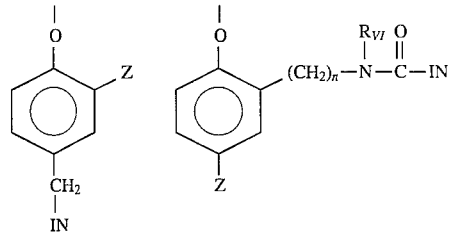

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1
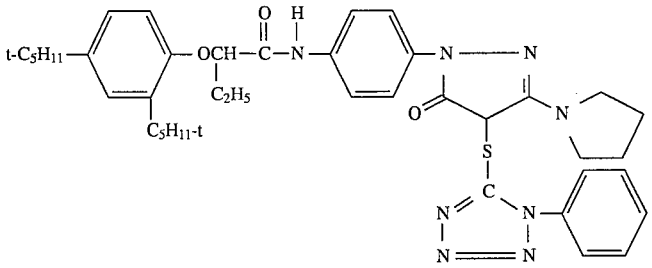
D2
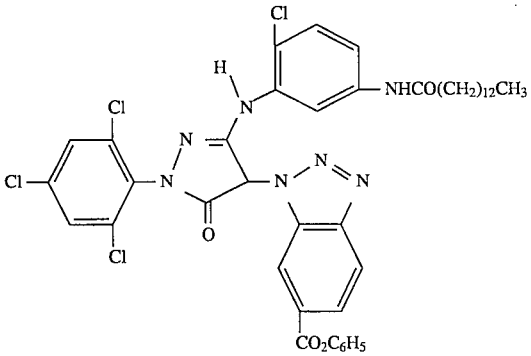
D3
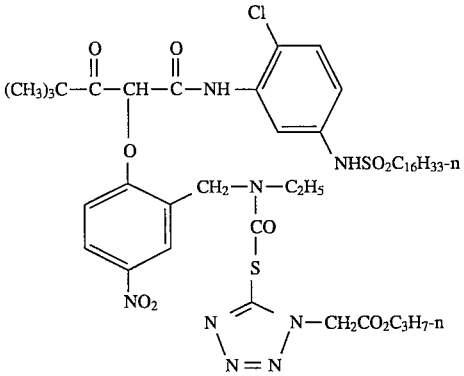
D4
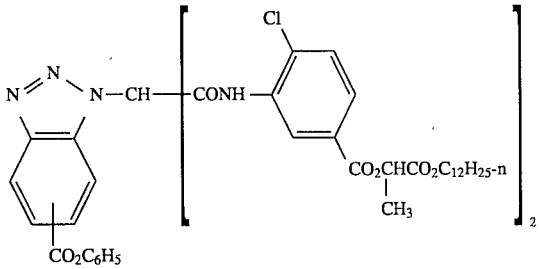
D-5
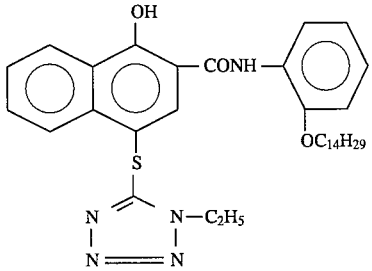
D-6
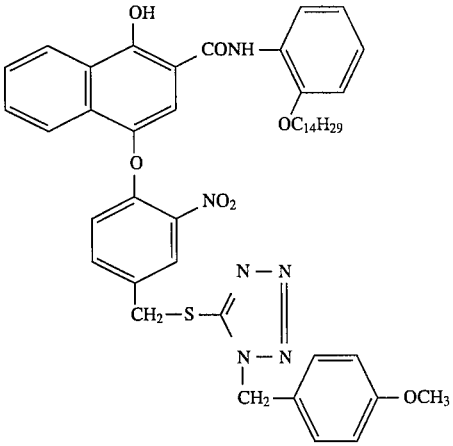
D7
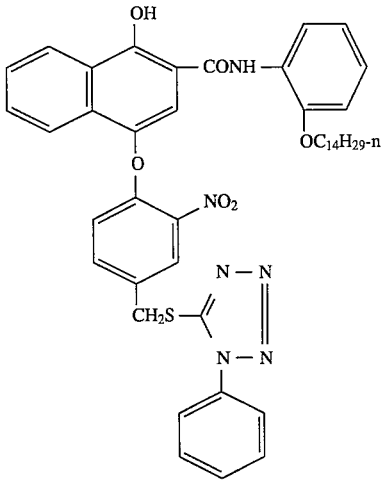

-continued

D8

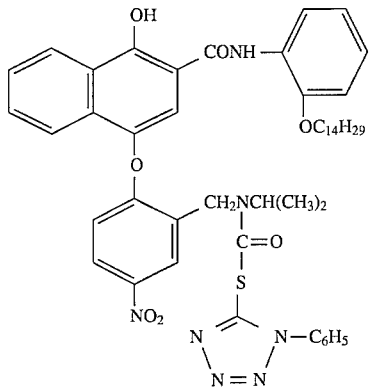

D9

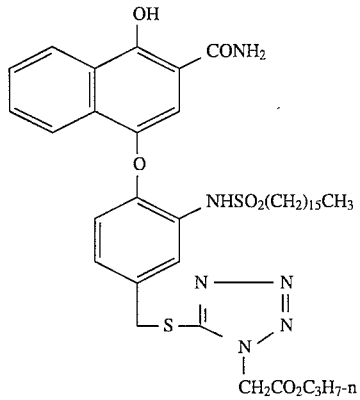

D-10

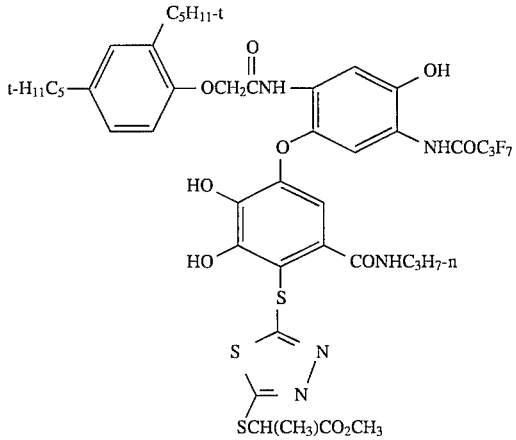

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agent s such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078, 230; 90-079,336; 90-079,337; 90-079,338; 90-079,690; 90-079,691; 90-080,487; 90-080,488; 90-080,489; 90-080, 490; 90-080,491; 90-080,492; 90-080,494; 90-085,928; 90-086,669; 90-086,670; 90-087,360; 90-087,361; 90-087, 362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09, 959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N, N-diethylaniline hydrochloride, 4-amino-3-methyl-N-ethyl-N-(β-(methanesulfonamido) ethyl) aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS EXAMPLE: Compound M-1

SYNTHETIC SCHEME FOR M-1

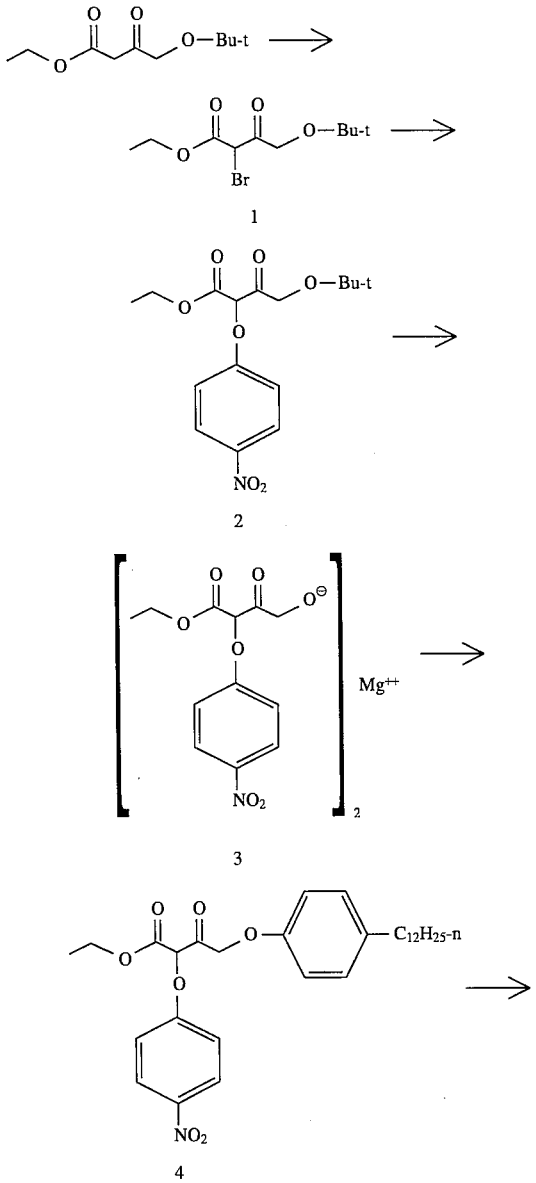

-continued

SYNTHETIC SCHEME FOR M-1

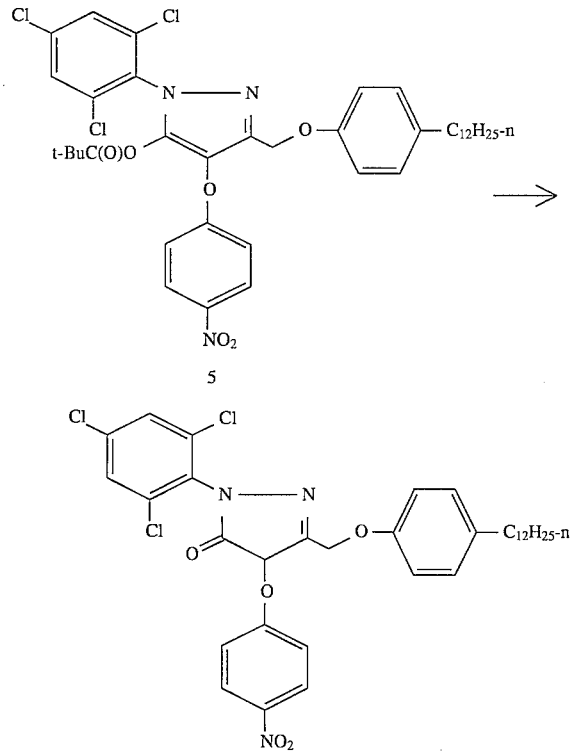

M-1

Preparation of t-butyl ethyl bromomalonate (1)

t-Butyl ethyl malonate (25.00 g, 0.13 mol) was dissolved in toluene and warmed to 80° C. To the resulting solution was added 1,3-dibromo-5,5-dimethylhydantoin (25.00 g, 0.07 mol). The reaction was stirred at elevated (80° C.) temperature 18 hr. The reaction was cooled, concentrated and taken up in $Et_2O$. The organic layer was washed with saturated $NaHCO_3$ (2×), brine (3×), dried ($MgSO_4$), filtered and concentrated. Purification by filtration on silica (70:30-heptane:ethyl acetate) yielded 33.0 g (93%) of a light yellow oil. NMR and MS indicated a mixture of three compounds, starting material (20%), monobrominated (55%) and dibromonated diesters (25%). The material was used without further purification.

Preparation of t-butyl ethyl-2-(p-nitrophenoxy) malonate (2)

p-Nitrophenol (3.58 g, 26 mmol) was flushed with $N_2$ and dissolved in dry THF (100 ml). To the resulting solution was added potassium t-butoxide (2.52 g, 22 mmol). The resulting orange solution was stirred for 15 min. and a solution of t-butylethyl bromomalonate (5.89 g, 0.022 mol) in dry THF (20 ml) added dropwise. The reaction was stirred at room temperature for 4 hr and concentrated. The residue was taken up in $Et_2O$ and the organic layer washed with $H_2O$ (1×), saturated $NaHCO_3$ (4×), brine (3×), dried ($MgSO_4$), filtered and concentrated. The resulting solid was stirred in heptane, filtered (2×) to remove t-butyl ethyl malonate contaminate. The solid was dissolved in ethyl acetate (100 ml) and an aqueous solution of sodium dithionite (100 ml; $Na_2S_2O_4$ 125 g/l) added. The two phase solution is stirred 18 hr. The phases are separated and the organic phase washed with $H_2O$ (2×), brine (2×), dried ($MgSO_4$), filtered and concentrated. The resulting off white solid 6.35 g (88%) is used without further purification.

Preparation of ethyl-(m-nitrophenyloxy)-malonate magnesium salt (3)

t-Butyl ethyl-2-(p-nitrophenyloxy) malonate (37.2 g, 0.11 mol) was dissolved in $CH_2Cl_2$ (400 ml) and trifluoroacetic acid (100 ml) added. The reaction was stirred for 2 hr and taken up in $CH_2Cl_2$. The solution was washed with $H_2O$ (3×), brine (2×), dried ($MgSO_4$), filtered and concentrated (bath temp <45° C.). The resulting oil was purified on silica gel (60A; 230–400 mesh; 70:30-heptane:ethyl acetate then acetone) yielding 27.1 g (88%) of a white solid. The white solid was flushed with $N_2$ and dissolved in dry THF (250 ml). To the resulting solution was added $Mg(OEt)_2$ (5.33 g, 0.046 mol). The solution was stirred 18 hr at room temperature and concentrated (bath temp <45° C.). The resulting foam was twice diluted with dry cyclohexane (~50 ml) and concentrated. The solid was dried under high vacuum to a free flowing off-white solid. The material was used without further purification.

Preparation of ethyl-2-(p-nitrophenyloxy)-4-(p-dodecylphenyloxy) acetoacetate (4)

Carbonyldiimidazole (16.9 g, 104 mmol) was flushed with $N_2$ and dissolved in dry THF (200 ml). To the resulting solution was added a solution of dodecylphenyloxyacetic acid (30.6 g, 104 mmol) in dry THF (l 50 ml). The reaction was stirred two hours at room temperature, then ethyl-(p-nitrophenyloxy)malonate magnesium salt (23.4 g, 87 mmol) was added in portions over 5 minutes. The reaction was stirred at room temperature 18 hr and quenched with $NH_4Cl$. The solution was concentrated and taken up in $Et_2O$. The organic layer was washed with, 1M HCl (1×), $H_2O$ (2×), sat. $NaHCO_3$ (2×), brine (2×), dried ($MgSO_4$), filtered and concentrated. Purification on silica. (60A; 230–400 mesh; 80:20-heptane:ethyl acetate) yielded 33.47 g (74%) of a light yellow oil.

Preparation of Compound M-1-Pivolate (5)

Ethyl-2-(p-nitrophenyloxy)-4-(p-dodecylphenyloxy) acetoacetate (9.10 g, 17 mmol) was flushed with $N_2$ and dry MeOH (200 ml ) added. Approximately 10 ml THF was added to improve solubility. Trichlorophenylhydrazine (4.00 g, 18 mmol) was added followed by HCl(g) (until the reaction mixture was homogenous ca.35 sec). The reaction was stirred for 18 hr, diluted With $Et_2O$ (200 ml) and filtered. The resulting solution was washed with $H_2O$ (2×), saturated $NaHCO_3$ (2×), brine (2×), dried ($MgSO_4$), filtered and concentrated. The resulting oil was flushed with $N_2$ and dissolved in $CH_2Cl_2$. Pivaloyl chloride (5 ml, 45 mmol) was added and followed by N,N-dimethylaminopyridine (0.4 g). The solution was stirred 10 min. then a solution of $Et_3N$ (8.0 ml, 57 mmol) in $CH_2Cl_2$ was added dropwise. The resulting dark solution was stirred 1 hr and taken up in $CH_2Cl_2$. The organic portion was washed with 0.5M HCl (2×), $H_2O$ (2×), saturated $NaHCO_3$ (2×), brine (2×), dried ($MgSO_4$), filtered and concentrated. Purification on silica (60A; 230–400 mesh; 90:10-heptane:ethyl acetate) and recrystalization from ethanol/heptane/water yielded 4.03 g (31%) of a white solid.

Preparation of M-1

M-1-pivolate (16.13 g, 21 mmol) was flushed with $N_2$ and dissolved in THF (5 ml) and dry MeOH (40 ml). $K_2CO_3$ (0.44 g, 32 mmol) was added and the reaction stirred at room temperature for 1 hr The resulting solution was taken up in $Et_2O$ and the organic portion washed with 0.5M HCl (2×), sat. $NaHCO_3$ (2×), $Na_2S_2O_4$ (500 g/l) (2×), brine (2×), dried ($MgSO_4$), filtered and concentrated yielding 4.52 g (91%) of a white solid. Analysis showed the compound corresponded to M-1.

Preparation of Unstable Comparison C-5

C-5-pivolate (prepared by a procedure similar to M-1-pivolate) (5.89g, 8.0 mmol) was flushed with $N_2$ and dissolved in dry MeOH (50 ml). $K_2CO_3$ (0.29g, 21 mmol) was added and the reaction stirred at room temperature for three hours. The resulting solution was treated as above and the resulting oil chromatographed over silica (70/30 heptane: ethyl acetate). Concentration of the pure fractions under a variety of conditions led to product decomposition.

Photographic Examples

For the photographic examples, aqueous dispersions were prepared by adding an oil phase containing 1.0 g of coupler, 1.0 g of coupler solvent (tritolyl phosphate, mixed isomers) and 3.0 g of ethyl acetate to a solution of 3.0 g of gelatin and 0.3 g of the sodium salt of tri-isopropylnaphthalene sulfonic acid (dispersing agent) in sufficient water to yield a total volume of 50 ml. Each of the resulting mixtures was passed through a colloid mill to disperse the coupler-containing oil phase in the aqueous phase as small particles. The resulting dispersions contained 2% by weight of coupler and 2% by weight of coupler solvent.

Sufficient coupler to yield a laydown of 0.646 mmol/sq.m was mixed with a silver iodobromide emulsion and additional gelatin and coated on cellulose acetate butyrate support as diagrammed below. The ethyl acetate in the dispersion evaporates on drying. The layer containing coupler and silver halide was overcoated with a layer containing gelatin and the hardener bis(vinylsulfonylmethyl) ether, as shown below.

| |
|---|
| 5.38 g/sq. m gelatin (overcoat) |
| 0.161 g/sq. m bis(vinylsulfonylmethyl) ether hardener |
| 2.69 g/sq.m gelatin |
| 0.646 mmol/sq.m magenta dye-forming coupler |
| tritolyl phosphate at equal weight to coupler |
| 1.61 g Ag/sq.m as a 0.46μ silver bromoiodide (6.4% iodide) emulsion |
| cellulose acetate butyrate support |

After the films had hardened they were subjected to keeping tests as described below and then were exposed through a step tablet on a 1B sensitometer and then subjected to a modified KODAK FLEXICOLOR C-41 color negative process, as described in The British Journal of Photography Annual of 1988, pages 191–198, with details as below.

C-41 PROCESSING SOLUTIONS AND CONDITIONS

| Solution | Processing Time | Agitation Gas |
|---|---|---|
| A) C-41 Developer | 3'15" | Nitrogen |
| Stop Bath | 30" | Nitrogen |
| Bleach | 3' | Air |
| Wash | 1' | None |
| Fix | 4' | Nitrogen |
| Wash | 4' | None |
| Bath containing wetting agent | 30" | None |
| Processing temperature 100° F. | | |

The bleach in the process was modified to contain 1,3 propylene diamine tetracetic acid. The process includes the use of an optional acidic stop solution following development and includes contacting the sample with an optional aqueous solution of wetting agent as the final step before drying so as to eliminate spot formation.

To evaluate the stability of the coupler, film samples were subjected to an accelerated raw stock keeping test. The test consisted of storage of unexposed, unprocessed samples at either 100° F. or 120° F. and 50% relative humidity for 4 weeks. Samples were then exposed and processed together with reference samples that had been stored in a freezer for the same period prior to exposure and processing. Values of Dmax, the maximum density obtained at high exposure, were compared. Dmax values were corrected for Dmin to remove contributions to green density from the support and other coating components. The ratio of the Dmax obtained from an incubated sample relative, to a sample of the same film stored in a freezer for the same period prior to exposure and processing, is referred to as the Density Ratio. This ratio is a measure of the raw stock stability of the coupler in the film composition, with ratios approaching 1.00 being desirable. Values less than 0.80 are termed unacceptable while values of 0.90 or more are preferred.

In the following examples, the indicated comparison examples were employed:

| COUPLER | FORMULA | Σσ | Σσ* |
|---|---|---|---|
| C-1 | 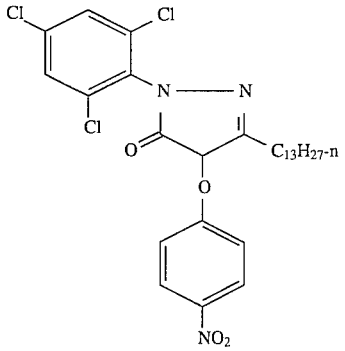 | 0.78 | 0.61 |
| C-2 | 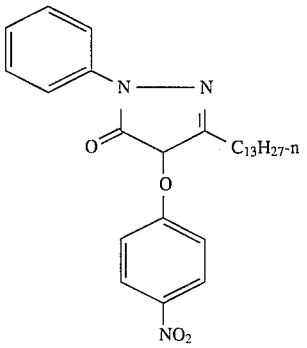 | 0.78 | 0.61 |
| C-3 | 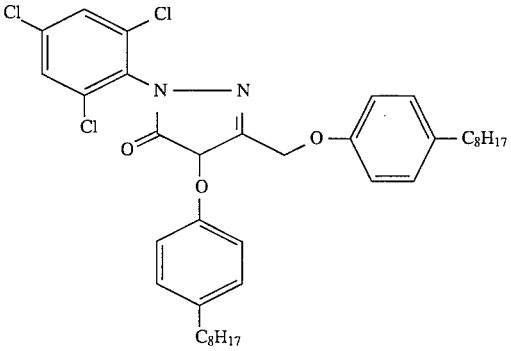 | −0.16 | 3.28 |
| C-4 | 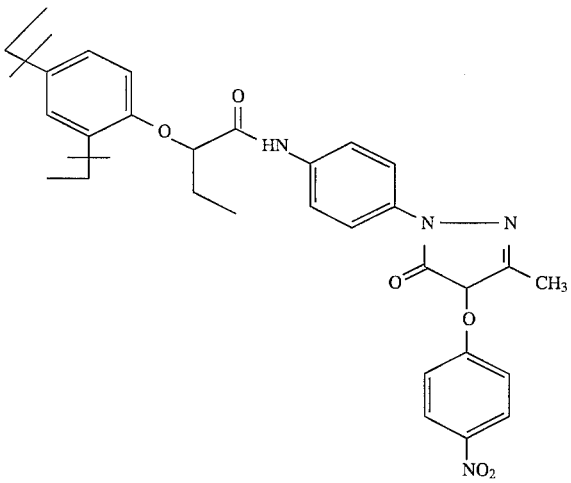 | 0.78 | 1.47 |

-continued

| COUPLER | FORMULA | Σσ | Σσ* |
|---|---|---|---|
| C-5 | 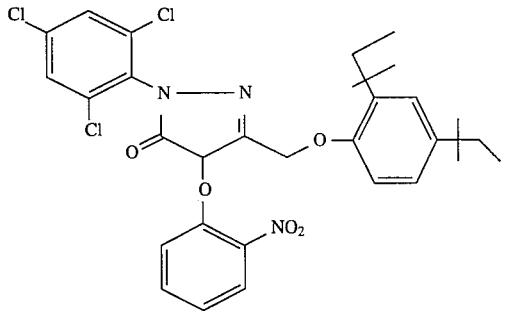 | 0.78 | 3.28 |
| C-6 | 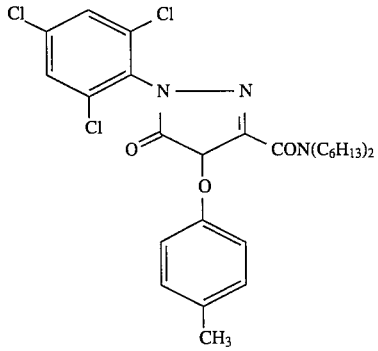 | −0.14 | 1.94 |

Example 1

Couplers of this invention M-1 through M-5, M-26, and comparison couplers C-1, C-2, and C-4 were dispersed and coated as described and subjected to an accelerated raw stock keeping test under the conditions indicated. After keeping, samples were exposed and subjected to Flexicolor C-41 processing as indicated. The inventive couplers were all based on the same coupling-off group while the substituents in the parent pyrazolone at the 1-position (nitrogen) and the 3-position (carbon) were varied. Table I shows the results of the tests.

TABLE I

| | Density Ratio Improvements | | | |
|---|---|---|---|---|
| Coupler | Type | Σσ | Σσ* | Density Ratio+ |
| C-1 | Comp | 0.78 | 0.61 | 0.46 |
| C-2 | Comp | 0.78 | 0.61 | 0.49 |
| C-4 | Comp | 0.78 | 1.47 | 0.62 |
| M-1 | Inv | 0.78 | 3.28 | 1.00 |
| M-2 | Inv | 0.78 | 3.28 | 1.00 |
| M-3 | Inv | 0.78 | 3.28 | 1.00 |
| M-4 | Inv | 0.78 | 2.69 | 0.97 |
| M-5 | Inv | 0.78 | 3.28 | 1.00 |
| M-26 | Inv | 0.78 | 3.28 | 1.00 |

+ Keeping results are based on 4 weeks @ 120° F.

It is evident from the Density Ratio values in Table I that the photographic elements of the invention which contain the specified magenta dye forming couplers show satisfactory stability in the raw stock keeping test. Excellent results are obtained for couplers where the substituent bonded to the nitrogen at the 1-position is unsubstituted phenyl (M-3), substituted phenyl (M-1, 2, 4, 5) or heteroaromatic (M-26). Variation in the 3-position as permitted by the invention also produced excellent results.

The comparison couplers failed to produce acceptable results. Couplers C-1, C-2 and C-4 are all deficient in the substituent bonded to the carbon alpha to the 3-position. Each comparison has a Taft constant (σ*) sum of less than 1.5.

Example 2

Photographic element samples were prepared and tested in a manner similar to Example 1 except this time the type of parent pyrazolone group was held constant while the coupling-off group was varied in order to determine the effect on the keeping results. Table II shows the results of testing.

TABLE II

| | Density Ratio Improvements | | | |
|---|---|---|---|---|
| Coupler | Type | Σσ | Σσ* | Density Ratio+ |
| M-1 | Inv | 0.78 | 3.28 | 1.00 |
| M-2 | Inv | 0.78 | 3.28 | 1.00 |
| M-6 | Inv | 0.73 | 3.28 | 1.00 |
| M-7 | Inv | 0.65 | 3.60 | 0.90 |
| M-27 | Inv | 0.73 | 3.28 | 1.00 |
| C-3 | Comp | −0.16 | 3.28 | 0.46 |
| C-5 | Comp | 0.78 | 3.28 | ++ |

+ Keeping results are based on 4 weeks @ 100° F.
++ This comparison compound could not be tested because it was so unstable that it could not be isolated and incorporated in film.

As shown by Table II, satisfactory results in the keeping test are not obtained when the substituents on the aromatic group of the coupling-off group are not within the invention. The sum of the Hammett constant (σ) values for these substituents of the coupling-off group are either less than 0.3 or there is a nitro group in the ortho position which results in a chemically unstable product. On the other hand, the five Examples of the invention provide Density Ratios of 0.9 or higher which means good stability.

Example 3

Solution Test

A solution test was developed as a means of providing a simplified means of predicting whether a particular coupler will prove satisfactory under "in-film" keeping conditions. For the Solution Test, a solution of coupler (7 ml, $1\times10^{-3}$M) in tritolyl phosphate/ethyl acetate (6:1) is placed in a test tube which is sealed with a rubber septum. The solution is saturated with oxygen for at least 15 minutes and then stirred at 23° C. Samples for analysis with high-performance liquid chromatography (HPLC) are removed at intervals with a syringe while maintaining the oxygen atmosphere. The coupler remaining percentage is calculated on the basis of HPLC peak areas after 8 days keeping of the solution.

Results of testing were as follows:

TABLE III

| | Solution vs In-Film Density Ratios | | | |
|---|---|---|---|---|
| COUPLER | IN SOLUTION COUPLER REMAINING RATIO | IN FILM DENSITY RATIO | Σσ | Σσ* |
| M-4 | 0.65 | 0.95 | 0.78 | 2.69 |
| M-28 | 0.73 | — | 0.78 | 1.73 |
| M-29 | 0.99 | — | 0.78 | 1.73 |
| C-1 | 0.16 | 0.49 | 0.78 | 0.61 |

As can be appreciated, an "in-solution" ratio of about 0.50 corresponds to the objective for acceptable "in-film" keeping of about 0.80.

Example 4

Hues of the dyes derived from the magenta-dye forming couplers of this invention with strongly withdrawing substituents at the 3-position were compared. For this example dispersions and coatings were prepared by procedures similar to those previously described. In this case the coated samples were exposed and processed as in Example 1 but without incubation, and the spectra were recorded at an exposure level that provided a dye density of approximately 1.0. As can be seen by comparison of the data in Table IV, the comparison coupler C-6, having a carbamoyl group directly bonded to the 3-position carbon does not provide the necessary hue ($^{\lambda}$max=540 to 560) to be a useful magenta dye-forming photographic element.

TABLE IV

| COUPLER | TYPE | $\lambda_{max}$ |
|---|---|---|
| M-1 | Invention | 554 |
| M-2 | Invention | 554 |
| M-5 | Invention | 550 |
| C-6 | Comparison | 567 |

What is claimed is:

1. A photographic element comprising a light-sensitive silver halide emulsion layer having associated therewith a coupler based on a 1-aryl-2-pyrazolin-5-one ring and represented by formula I:

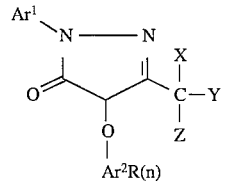

I wherein:

$Ar^1$ and $Ar^2$ are each independently aryl groups comprising a carboaromatic or heteroaromatic ring;

X, Y, and Z are bonded to a carbon atom alpha to the 3-position and are independently selected from the group consisting of hydrogen and substituent groups such that the sum of the Taft σ* values for X, Y, and Z is at least 1.5, provided that at least one of X, Y, and Z is a substituent including an atom bonded to the carbon atom alpha to the 3-position selected from the group consisting of a sulfur atom, an oxygen atom, and a nitrogen atom;

R represents n independently selected substituent groups bonded to the $Ar^2$ ring, provided that the sum of the Hammett σ constants for all R substituent groups, including any adjustment for heteroatoms contained in the $Ar^2$ ring, is at least 0.3, and provided further that two of X, Y, and Z may join to form a ring; and n is 0 to 5;

provided that R may not be a nitro group ortho to the oxygen atom bonding $Ar^2$ to the 1-aryl-2-pyrazolin-5-one ring.

2. The element of claim 1 wherein $Ar^1$ and $Ar^2$ are phenyl groups.

3. The element of claim 2 wherein $Ar^1$ is a phenyl group and $Ar^2$ is a p-nitrophenyl group.

4. The element of claim 3 wherein $Ar^1$ is a 2,4,6 trichlorophenyl group.

5. The element of claim 3 wherein $Ar^1$ is a 2,4 dimethyl-6-chlorophenyl group.

6. The element of claim 2 wherein there is present at least one R group that is nitro.

7. The element of claim 6 wherein said nitro is para to the oxygen atom linking $Ar^2$ to the 2-pyrazolin-5-one ring.

8. The element of claim 1 wherein at least one of X, Y, and Z is a substituent including a sulfur atom bonded to the carbon atom alpha to the 3-position.

9. The element of claim 1 wherein at least one of X, Y, and Z is a substituent including an oxygen, atom bonded to the carbon atom alpha to the 3-position.

10. The element of claim 9 wherein at least one of X, Y, and Z is a phenoxy group.

11. The element of claim 1 wherein at least one of X, Y, and Z is a substituent including a nitrogen atom bonded to the carbon atom alpha to the 3-position.

12. The element of claim 11 wherein at least one of X, Y, or Z is a substituent group including $—NR^1R^2$ linked to the carbon atom alpha to the 3-position, wherein $R^1$ is a substituent group and $R^2$ is hydrogen or a substituent group.

13. The element of claim 1 wherein there is present at least one R group that is nitro.

14. The element of claim 1 wherein $Ar^2$ is a carbocyclic aromatic ring having at least one R selected from the group consisting of halogen, $—NO_2$, —CN, $—NR'SO_2R''$, —NR'C(O)R'', —C(O)N(R')R'', —C(O)OR', $—PO(OR')_2$, —OC(O)R', —C(O)R', $—OSO_2R'$, $—SO_2R'$, $—SO_2N(R')R''$, $—SO_2OR'$ and halogenated alkyl wherein each R' and R'' is independently hydrogen or a substituent group.

15. The element of claim 1 wherein at least one R group is capable of releasing a PUG during processing of the element.

16. A photographic element comprising a light-sensitive silver halide emulsion layer having associated therewith a coupler based on a 1-aryl-2-pyrazolin-5-one ring and represented by formula I:

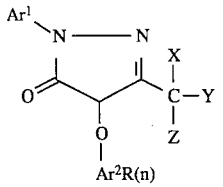

I wherein:

$Ar^1$ and $Ar^2$ are each independently aryl groups comprising a carboaromatic or heteroaromatic ring;

X, Y, and Z are bonded to a carbon atom alpha to the 3-position and are independently selected from the group consisting of hydrogen and substituent groups such that the sum of the Taft σ* values for X, Y, and Z is at least 1.5, provided that at least one of X, Y, and Z is selected from the substituent groups consisting of phenoxy, sulfonyl, acyl, acylamino, acyloxy, alkoxy, alkoxycarbonyl, alkylthio, carbamoyl, sulfamoyl, sulfonamido, phenyl, cyano, halogenated alkyl, and phenylthio groups;

R represents n independently selected substituent groups bonded to the $Ar^2$ ring, provided that the sum of the Hammett σ constants for all R substituent groups, including any adjustment for heteroatoms contained in the $Ar^2$ ring, is at least 0.3, and provided further that two of X, Y, and Z may join to form a ring; and n is 0 to 5;

provided that R may not be a nitro group ortho to the oxygen atom bonding $Ar^2$ to the 1-aryl-2-pyrazolin-5-one ring.

17. A photographic element comprising a light-sensitive silver halide emulsion layer having associated therewith a coupler comprising a 1-aryl-2-pyrazolin-5-one ring wherein said coupler has (a) an aryl group at the 1-position of the 1-aryl-2-pyrazolin-5-one ring;

(b) an alpha carbon atom bonded to the 3-position of the 1-aryl-2-pyrazolin-5-one ring, said alpha carbon atom bonded to at least one cyano group, or at least one substituent group bonded to the alpha carbon atom by a heteroatom, an acyl group, an aryl group, or a beta carbon atom bonded to three other atoms or groups at least one of said atoms or groups being halogen, an acyl group, a heteroatom, or a cyano group wherein said alpha carbon atom contains at least one substituent selected from the group consisting of a carbocyclic aromatic, phenoxy, sulfonyl, sulfonyloxy, sulfoxy, acyl, acylamino, acyloxy, alkoxy, alkylthio, alkoxycarbonyl, alkylthio, carbamoyl, sulfamoyl, sulfonamido, phenyl, cyano, phenylthio, and halogenated alkyl groups and the foregoing groups which are electron withdrawing groups when bonded to the alpha carbon through an alkylene group and wherein at least one of the substituents of said alpha carbon is bonded to the alpha carbon by oxygen, nitrogen or sulfur;

(c) an aryl group bonded to the 4-position of the 1-aryl-2-pyrazolin-5-one ring by an oxygen atom, said aryl group selected from the group consisting of (1) a carbocyclic aromatic group containing at least one substituent group selected from the group consisting of halogen, —$NO_2$, —CN, —NR'$SO_2$R", —NR'C(O)R", —PO(OR')$_2$, —C(O)N(R')R", —C(O)OR', —OC(O)R', —C(O)R', —OSO$_2$R',—SO$_2$R', —SO$_2$N(R')R", —SO$_2$OR' and halogenated alkyl wherein each R' and R" is independently hydrogen or a substituent group and (2) a heterocyclic aromatic group;

provided that said aryl group may not contain a nitro group ortho to the oxygen atom bonding said aryl group to the 1-aryl-2-pyrazolin-5-one ring.

18. A photographic element comprising a light-sensitive silver halide emulsion layer having associated therewith a coupler comprising a 1-aryl-2-pyrazolin-5-one ring wherein said coupler has (a) an aryl group at the 1-position of the 1-aryl-2-pyrazolin-5-one ring;

(b) an alpha carbon atom bonded to the 3-position of the 1-aryl-2-pyrazolin-5-one ring, said alpha carbon atom bonded to at least one cyano group, or at least one substituent group bonded to the alpha carbon atom by a heteroatom, an acyl group, an aryl group, or a beta carbon atom bonded to three other atoms or groups at least one of said atoms or groups being halogen, an acyl group, a heteroatom, or a cyano group wherein at least one of the substituents of said alpha carbon is a carbocyclic aromatic group;

(c) an aryl group bonded to the 4-position of the 1-aryl-2-pyrazolin-5-one ring by an oxygen atom, said aryl group selected from the group consisting of (1) a carbocyclic aromatic group containing at least one substituent group selected from the group consisting of halogen, —$NO_2$, —CN, —NR'$SO_2$R", —NR'C(O)R", —PO(OR')$_2$, —C(O)N(R')R", —C(O)OR', —OC(O)R', —C(O)R', —OSO$_2$R',—SO$_2$R', —SO$_2$N(R')R", —SO$_2$OR' and halogenated alkyl wherein each R' and R" is independently hydrogen or a substituent group and (2) a heterocyclic aromatic group;

provided that said aryl group may not contain a nitro group ortho to the oxygen atom bonding said aryl group to the 1-aryl-2-pyrazolin-5-one ring.

19. A photographic element comprising a light-sensitive silver halide emulsion layer having associated therewith a coupler comprising a 1-aryl-2-pyrazolin-5-one ring wherein said coupler has (a) an aryl group at the 1-position of the 1-aryl-2-pyrazolin-5-one ring;

(b) an alpha carbon atom bonded to the 3-position of the 1-aryl-2-pyrazolin-5-one ring, said alpha carbon atom bonded to at least one cyano group, or at least one substituent group bonded to the alpha carbon atom by a heteroatom, an acyl group, an aryl group, or a beta carbon atom bonded to three other atoms or groups at least one of said atoms or groups being halogen, an acyl group, a heteroatom, or a cyano group wherein at least one of the substituents of said alpha carbon atom is a cyano group bonded to the alpha carbon atom, or is bonded to the alpha carbon by an acyl group;

(c) an aryl group bonded to the 4-position of the 1-aryl-2-pyrazolin-5-one ring by an oxygen atom, said aryl group selected from the group consisting of (1) a carbocyclic aromatic group containing at least one substituent group selected from the group consisting of halogen, —$NO_2$, —CN, —NR'$SO_2$R", —NR'C(O)R", —$PO(OR')_2$, —C(O)N(R')R", —C(O)OR', —OC(O)R', —C(O)R', —$OSO_2R'$,—$SO_2R'$, —$SO_2N(R')R"$, —$SO_2OR'$ and halogenated alkyl wherein each R' and R" is independently hydrogen or a substituent group and (2) a heterocyclic aromatic group;

provided that said aryl group may not contain a nitro group ortho to the oxygen atom bonding said aryl group to the 1-aryl-2-pyrazolin-5-one ring.

20. A photographic element comprising a light-sensitive silver halide emulsion layer having associated therewith a coupler comprising a 1-aryl-2-pyrazolin-5-one ring wherein said coupler has (a) an aryl group at the 1-position of the 1-aryl-2-pyrazolin-5-one ring;

(b) an alpha carbon atom bonded to the 3-position of the 1-aryl-2-pyrazolin-5-one ring, said alpha carbon atom bonded to at least one cyano group, or at least one substituent group bonded to the alpha carbon atom by a heteroatom, an acyl group, an aryl group, or a beta carbon atom bonded to three other atoms or groups at least one of said atoms or groups being halogen, an acyl group, a heteroatom, or a cyano group wherein at least one of the substituents of said alpha carbon atom is a phenoxy group;

(c) an aryl group bonded to the 4-position of the 1-aryl-2-pyrazolin-5-one ring by an oxygen atom, said aryl group selected from the group consisting of (1) a carbocyclic aromatic group containing at least one substituent group selected from the group consisting of halogen, —$NO_2$, —CN, —$NR'SO_2R"$, —NR'C(O)R", —$PO(OR')_2$, —C(O)N(R')R", —C(O)OR', —OC(O)R', —C(O)R', —$OSO_2R'$,—$SO_2R'$, —$SO_2N(R')R"$, —$SO_2OR'$ and halogenated alkyl wherein each R' and R" is independently hydrogen or a substituent group and (2) a heterocyclic aromatic group;

provided that said aryl group may not contain a nitro group ortho to the oxygen atom bonding said aryl group to the 1-aryl-2-pyrazolin-5-one ring.

21. A photographic element comprising a light-sensitive silver halide emulsion layer having associated therewith a coupler comprising a 1-aryl-2-pyrazolin-5-one ring wherein said coupler has (a) an aryl group at the 1-position of the 1-aryl-2-pyrazolin-5-one ring;

(b) an alpha carbon atom bonded to the 3-position of the 1-aryl-2-pyrazolin-5-one ring, said alpha carbon atom bonded to at least one cyano group, or at least one substituent group bonded to the alpha carbon atom by a heteroatom, an acyl group, an aryl group, or a beta carbon atom bonded to three other atoms or groups at least one of said atoms or groups being halogen, an acyl group, a heteroatom, or a cyano group wherein at least one of the substituents of the carbon alpha to the carbon at the three position of the 1-aryl-2-pyrazolin-5-one ring is a phenoxy group;

(c) an aryl group bonded to the 4-position of the 1-aryl-2-pyrazolin-5-one ring by an oxygen atom, said aryl group selected from the group consisting of (1) a carbocyclic aromatic group containing at least one substituent group selected from the group consisting of halogen, —$NO_2$, —CN, —$NR'SO_2R"$, —NR'C(O)R", —$PO(OR')_2$, —C(O)N(R')R", —C(O)OR', —OC(O)R', —C(O)R', —$OSO_2R'$,—$SO_2R'$, —$SO_2N(R')R"$, —$SO_2OR'$ and halogenated alkyl wherein each R' and R" is independently hydrogen or a substituent group and (2) a heterocyclic aromatic group wherein said aryl group bonded to the 4-position of the 1-aryl-2-pyrazolin-5-one ring by an oxygen atom contains a nitro substituent;

provided that said aryl group may not contain a nitro group ortho to the oxygen atom bonding said aryl group to the 1-aryl-2-pyrazolin-5-one ring.

22. The element of claim 21 wherein said phenoxy group contains an alkyl or alkoxy substituent.

* * * * *